US006112923A

United States Patent [19]

Ma

[11] Patent Number: 6,112,923

[45] Date of Patent: Sep. 5, 2000

[54] TAMPER EVIDENT BOTTLE CAP

[75] Inventor: Xiaoli Ma, San Jose, Calif.

[73] Assignee: Portola Packaging, Inc., San Jose, Calif.

[21] Appl. No.: 09/323,571

[22] Filed: Jun. 1, 1999

Related U.S. Application Data

[63] Continuation-in-part of application No. 08/904,878, Aug. 1, 1997, Pat. No. 5,913,437.

[51] Int. Cl.[7] ..... B65D 41/34

[52] U.S. Cl. ..... 215/252; 215/44

[58] Field of Search ..... 215/252, 44

[56] References Cited

U.S. PATENT DOCUMENTS

| | | | |
|---|---|---|---|
| 4,732,289 | 3/1988 | Granat et al. . | |
| 4,801,031 | 1/1989 | Barriac . | |
| 4,813,561 | 3/1989 | Ochs | 215/252 |
| 5,105,960 | 4/1992 | Crisci et al. . | |
| 5,190,178 | 3/1993 | Luch . | |
| 5,285,912 | 2/1994 | Molinaro . | |
| 5,307,946 | 5/1994 | Molinaro . | |
| 5,346,082 | 9/1994 | Ochs et al. | 215/252 |
| 5,400,913 | 3/1995 | Kelly . | |
| 5,415,306 | 5/1995 | Luch et al. . | |
| 5,456,376 | 10/1995 | Luch et al. . | |
| 5,465,876 | 11/1995 | Crisci . | |
| 5,480,045 | 1/1996 | Molinaro et al. . | |
| 5,609,262 | 3/1997 | Trout | 215/219 |
| 5,660,288 | 8/1997 | Nyman, Jr. | 215/44 |

*Primary Examiner*—Stephen K. Cronin
*Attorney, Agent, or Firm*—Flehr Hohbach Test Albritton & Herbert LLP

[57] ABSTRACT

A closure cap (210) including a tamper-indicating band (218) with an inwardly and upwardly turned retaining rim (224) having ramp elements (226), and the neck (240) of a bottle includes corresponding ramp elements (244).

13 Claims, 12 Drawing Sheets

TAMPER EVIDENT BOTTLE CAP

RELATED APPLICATIONS

This is a continuation-in-part of application Ser. No. 08/904,878 entitled "Tamper Evident Bottle Cap," filed Aug. 1, 1997, now U.S. Pat. No. 5,913,437.

BACKGROUND OF THE INVENTION

1. Field of the Invention

This invention relates to improvements in tamper-evident bands such as those commonly used on bottle caps and, more particularly, to an improved detachable tamper-evidencing band design for improving mounting of the closure on a spout or neck of a container, as well as to improve the grip of the band on the spout.

2. Related Art

U.S. Pat. No. 4,801,031 discloses a tamper-indicating closure that includes an inwardly folded tamper-indicating band with intermittent pleats, around the inwardly folded portion of the band. The pleats are inwardly directed and spaced around the circumference of the band. U.S. Pat. No. 5,400,913 discloses a similar tamper-indicating closure that also has an inwardly folded tamper-indicating band with continuous pleats around the inwardly folded portion of the band.

As discussed in the '913 patent, the tamper-indicating band should slip over the locking bead or rim of the container neck without damaging the frangible web connecting the band to the skirt of the closure. The tamper-indicating band must be sufficiently elastic in order to avoid too great a resistance when closing the bottle, which could damage the frangible web. However, the tamper-indicating band should be sufficiently stiff in order to reliably engage the locking bead of the container neck and thereby hold the band beneath the locking bead when opening the closure, so that the tamper-indicating band will tear at the frangible web.

The '913 patent improves the flexibility of the inwardly folded pleated portion of the band in two ways. One, a frangible web is provided between each pleat. The frangible webs between the pleats ensure high elasticity of the tamper-indicating band during closure. Alternatively, individual bridges, instead of a frangible web, are provided between the pleats. The bridges are relatively easily damaged during opening of the closure, thus improving the tamper-indicating nature of the closure.

It has been determined by the applicant herein that the inwardly-turned pleated designs of both the '031 and '913 patents have a tendency to improperly grip the locking bead of the container neck and, thereby allow the tamper-indicating band to slip back upwardly over the locking bead upon opening of the closure, which defeats the tamper-indicating aspect of the designs. The present invention improves upon this aspect of prior art pleated tamper-indicating bands.

It is also known for the internal thread pattern of a bottle cap to include uniformly spaced gaps around the spiral thread bead for the purpose of reducing weight of the bottle cap as well as to simplify tooling production required to manufacture the bottle caps. The present invention also provides an improved spiral thread pattern and design.

SUMMARY OF THE INVENTION:

Briefly described, the present invention comprises a tamper-indicating closure for a container with a locking surface on the neck of the container, with the closure including a closure cap with a top portion and a depending annular skirt, a tamper-indicating band connected to the lower edge of the annular skirt by means of a frangible connection, the tamper-indicating band including an inwardly turned retaining rim that extends at least partially upwardly relative to the container neck, the retaining rim including a free edge that is adapted to engage the locking surface of the container neck, the free edge of the retaining rim including ramp elements that provide for one-way screwing of the closure cap onto a neck having corresponding ramp elements.

BRIEF DESCRIPTION OF THE DRAWINGS

The accompanying drawings, which are incorporated in and form a part of this specification, illustrate embodiments of the invention and, together with the description serve to explain the principles of the invention, wherein.

DETAILED DESCRIPTION OF THE PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
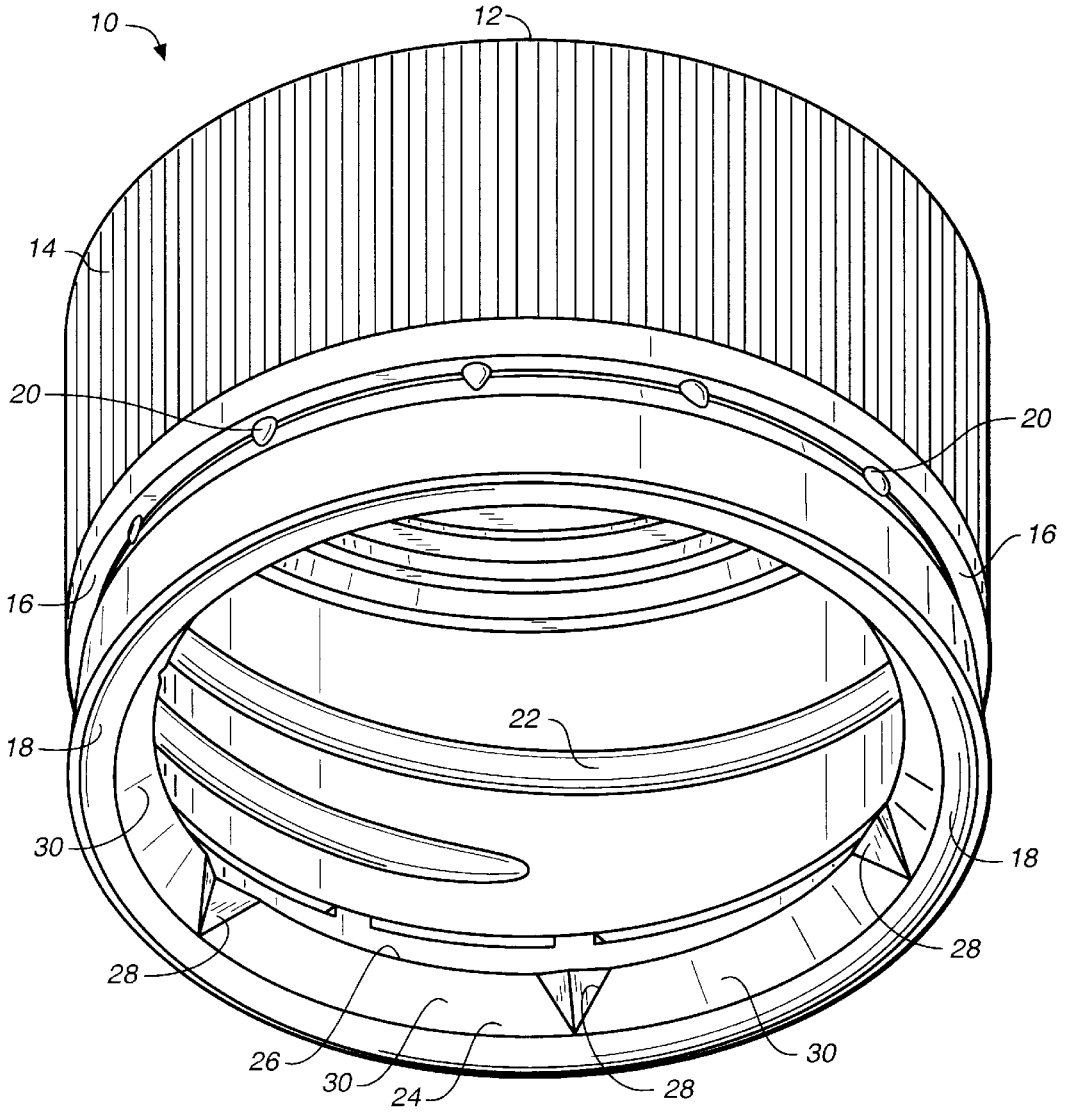
FIG. 1 is a pictorial view of the bottle cap of the present invention.

Referring to FIG. 1, bottle cap 10 forms a closure for capping off a spout or container neck of a bottle (not shown). Bottle cap 10 includes a round top portion 12 and a depending annular or cylindrical skirt 14. Skirt 14 includes a lower edge 16, to which a tamper-indicating band 18 connects by means of a frangible connection in the form of thin-walled, breakable connections 20. The internal side wall of skirt 14 includes a conventional spiral thread bead 22. The novelty of the embodiment of the present invention shown in FIG. 1 is believed to reside in the design of tamper-indicating band 18 and, accordingly, the design of top portion 12 and depending annular skirt 14 by themselves form no part of the present invention.

Tamper-indicating band 18 includes an inwardly and upwardly turned, annular retaining rim 24. Retaining rim 24 includes an upper free edge 26. The free edge 26 includes pleats 28, which are pleated radially outwardly, and arcuate portions 30 therebetween.

Figure 2:
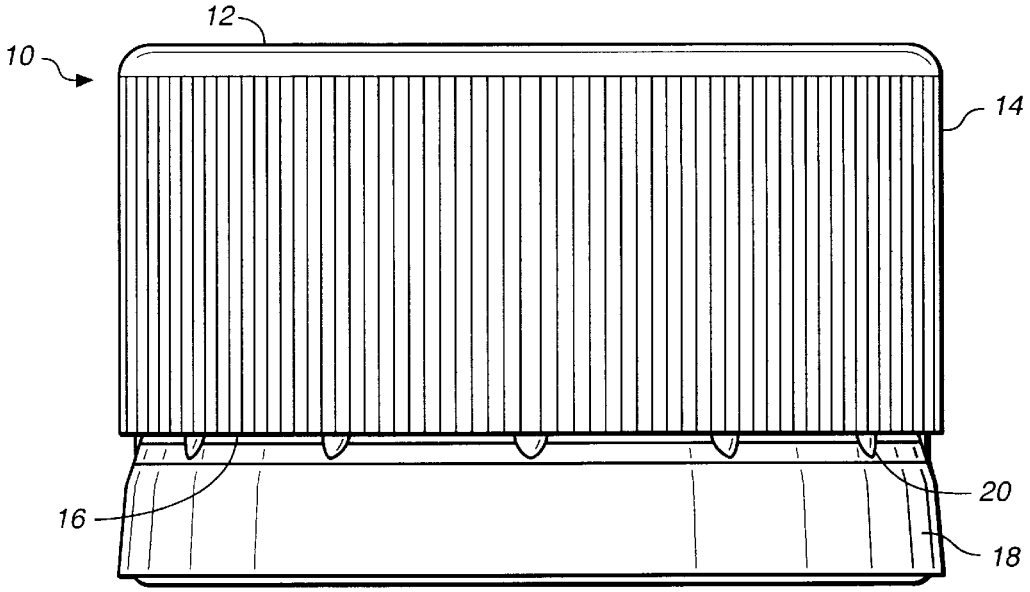
FIG. 2 is a side elevation view of the bottle cap of FIG. 1.
Figure 3:
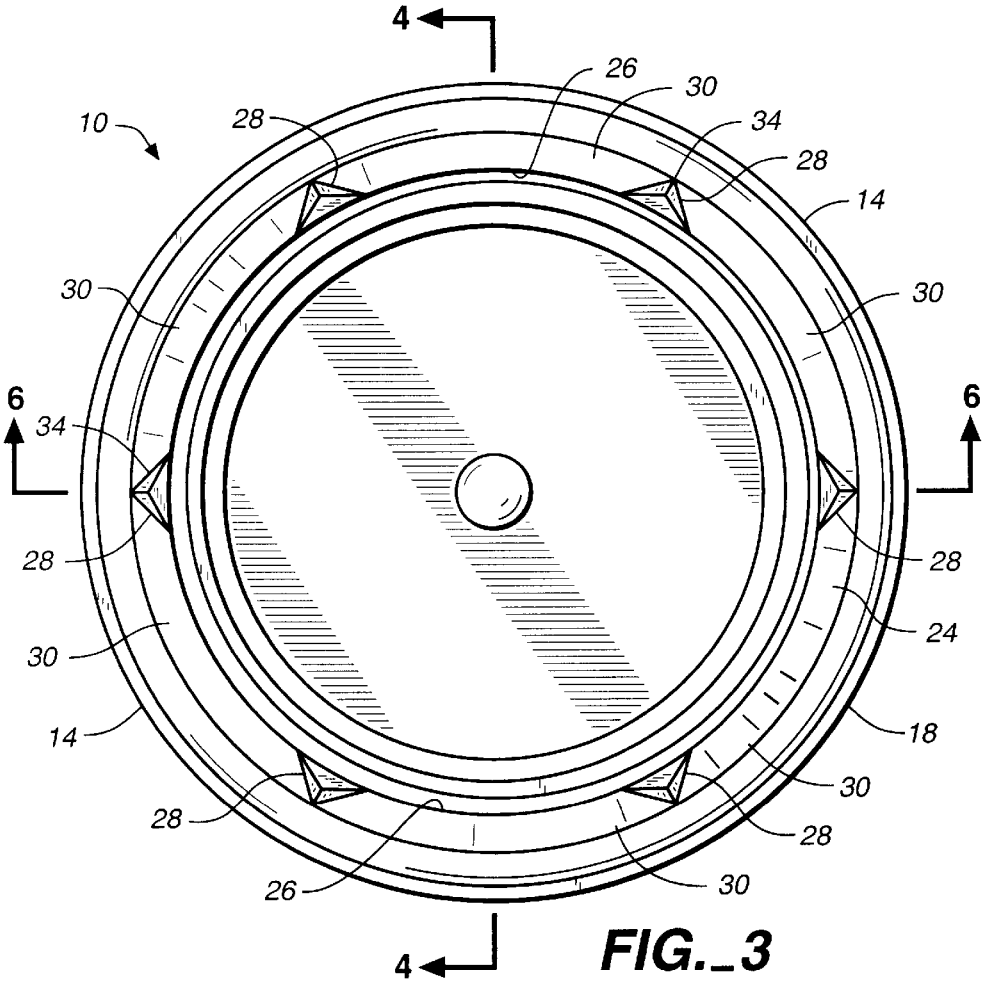
FIG. 3 is a bottom plan view of the bottle cap of FIG. 2.
Figure 4:
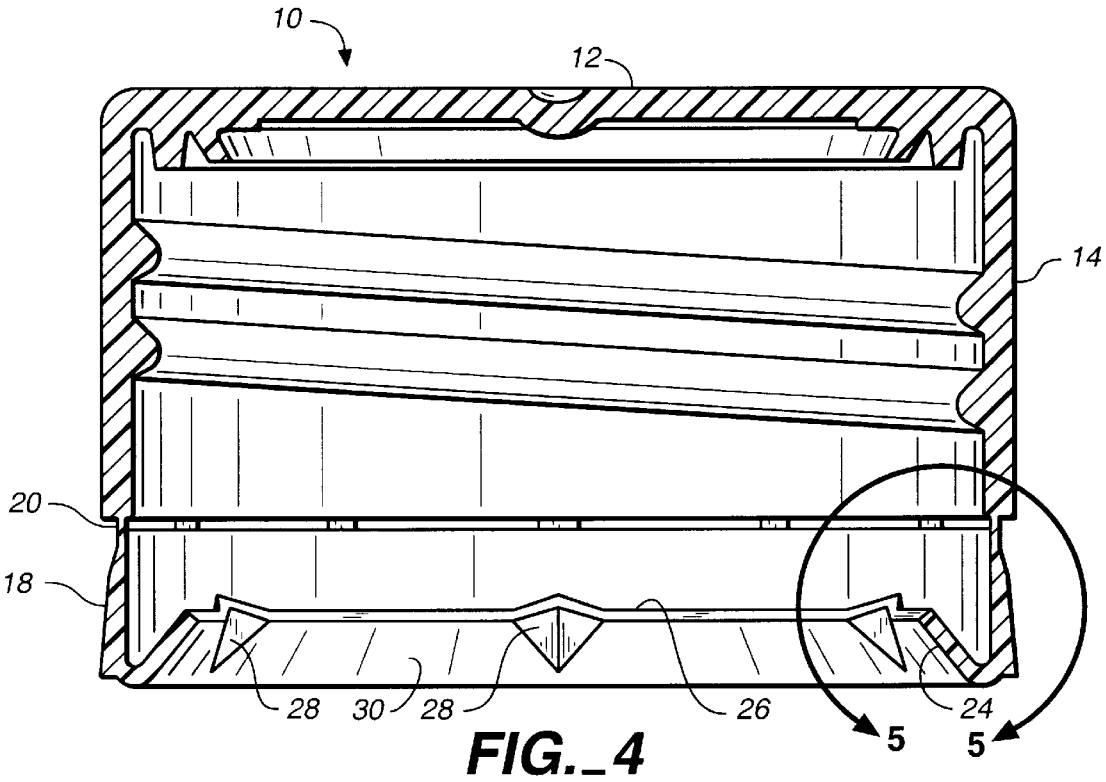
FIG. 4 is a sectional view, taken along the line 4—4 of FIG. 3.
Figure 5:
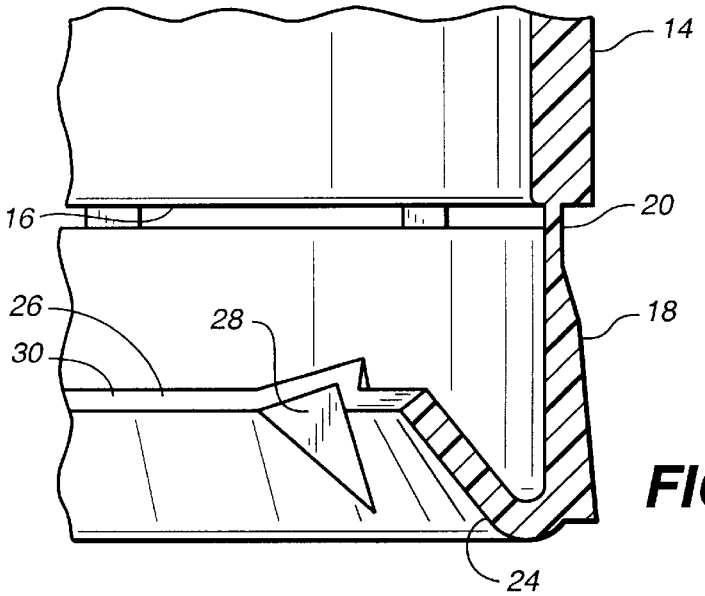
FIG. 5 is an enlarged, detail view of the retaining rim of the bottle cap of FIG. 4.
Figure 6:
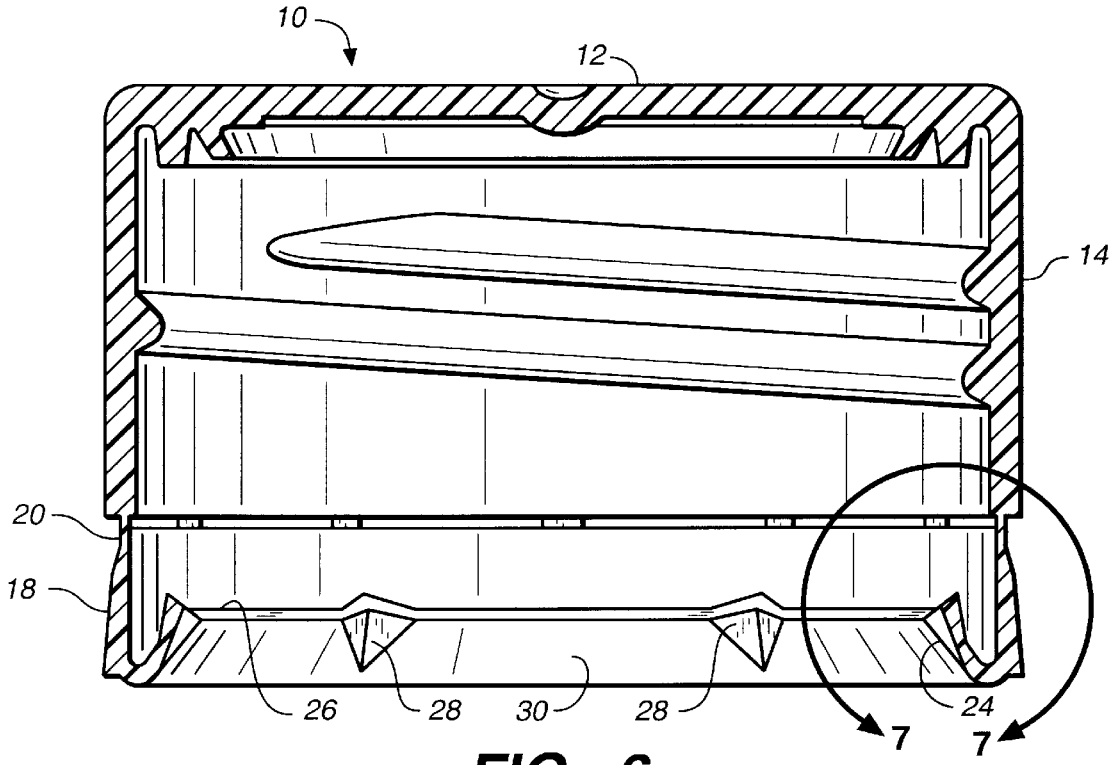
FIG. 6 is a sectional view, taken along the line 6—6 of FIG. 3.
Figure 7:
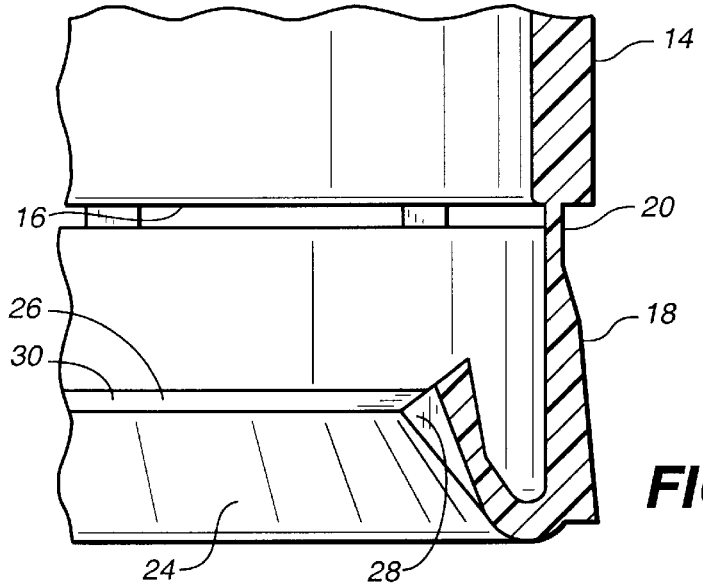
FIG. 7 is an enlarged, detail view of the retaining rim of the bottle cap of FIG. 6.

Referring to FIGS. 2 and 3, bottle cap 10 includes a series of frangible connections 20 that are formed by thin wall segments which have sufficient compressive rigidity to withstand the compressive forces imposed by tamper-indicating band 24 as the bottle cap is mounted onto a container spout, yet also has minimal tensile strength so that the frangible connections 20 break when the bottle cap is threaded back off of the container spout.

A series of six flutes 28 are formed in the upwardly and inwardly turned retaining rim 24. While the present invention is not meant to be limited to a particular number of flutes, it is desirable to provide at least two flutes and preferably at least four. In the embodiment shown, the flutes are formed as pleats, six in number.

However, other flute designs can be used so long as the design allows the upper edge of the rim to expand. Provision of six pleats, of course, creates six arcuate portions 30 along the free edge 26. Arcuate portions 30 have a radius of curvature that approximates the curvature of the container spout so that when the bottle cap is mounted onto the container neck, the upper edge 26 of the arcuate portions firmly grips a locking surface on the container neck. 5 Pleats 28 are pleated radially outwardly of arcuate portions 28. In other words, pleats 28 fold outwardly of arcuate portions 30 toward the depending annular skirt 14. Pleats 28 include a vertex 34 that is spaced a short distance inwardly of skirt 14. Preferably, the depth of pleats 28 is sufficient that the outer extremity 34, i.e. the vertex, of each pleat remains underneath the locking surface of the container neck. This is 10 discussed in more detail with reference to FIG. 11.

Referring to FIGS. 4–7, the inwardly turned retaining rim 24 extends at least partially upwardly so that its upper free edge 26 faces upwardly and is positioned to engage the locking surface of the container neck. It can also be seen in these figures that the pleats 28 extend radially outwardly from arcuate portions 30. It is known to provide inwardly projecting pleats, such as those found on the bottle caps disclosed in the prior mentioned Kelly '913 patent and the Barriac '031 patent. Inwardly projecting pleats result in less upper free edge contact with the locking surface of the container neck, which can result in the retaining rim slipping over the locking surface without the frangible connections breaking when the bottle cap is initially unscrewed off of the container neck.

The thin wall construction of frangible connections 20 allows for relatively easy breakage of the frangible material when the free edge 26 of retaining rim 24 engages the locking surface of the container neck. Yet, frangible connections 20 have sufficient compressive strength to withstand the initial compressive forces of tamper-indicating band 18 when the bottle cap is first threaded onto the container neck.

Figure 8:
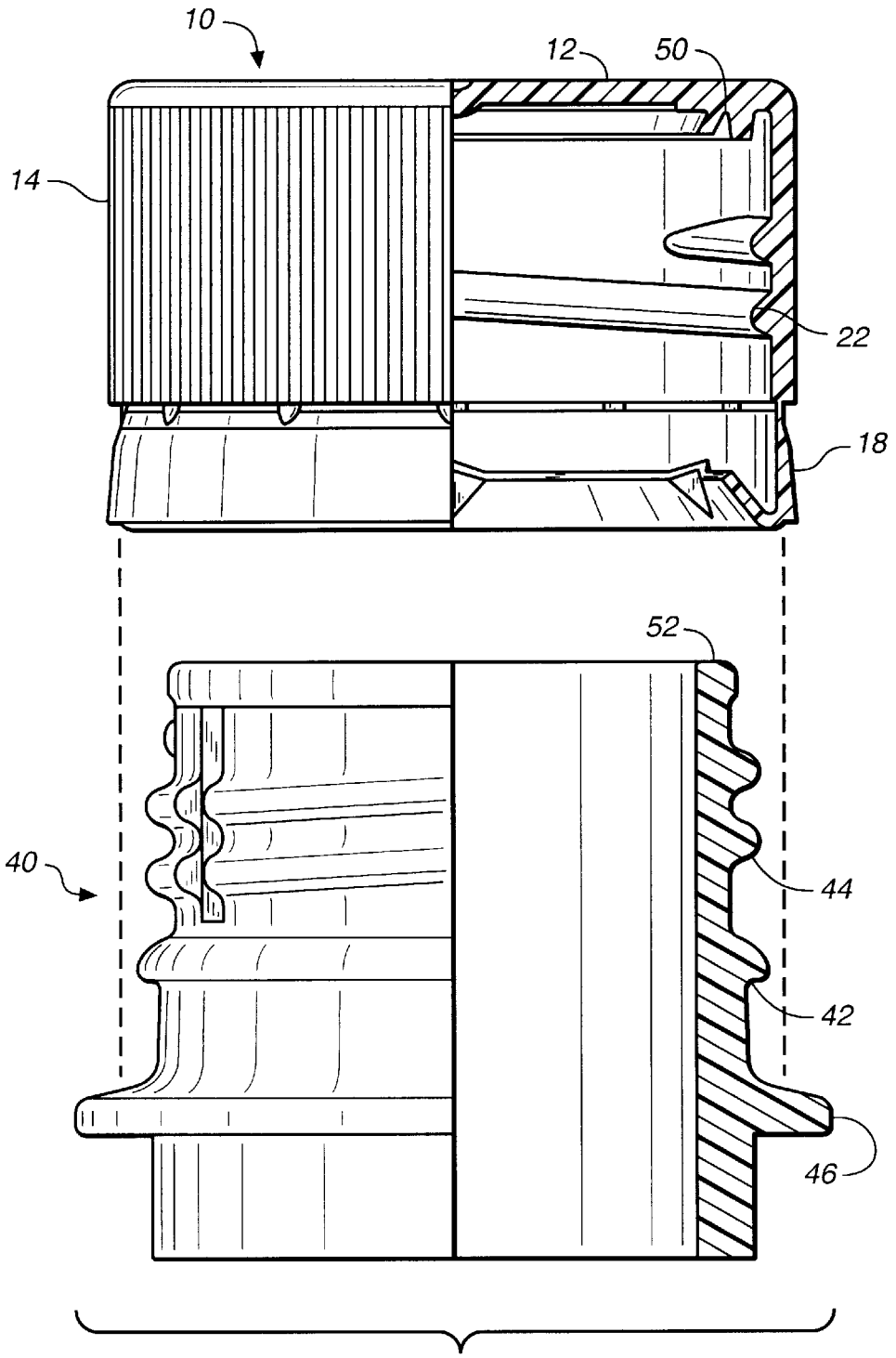
FIG. 8 is an exploded view of the bottle cap of FIG. 1 and a container neck, with the bottle cap and container neck shown in quarter section.
Figure 9:
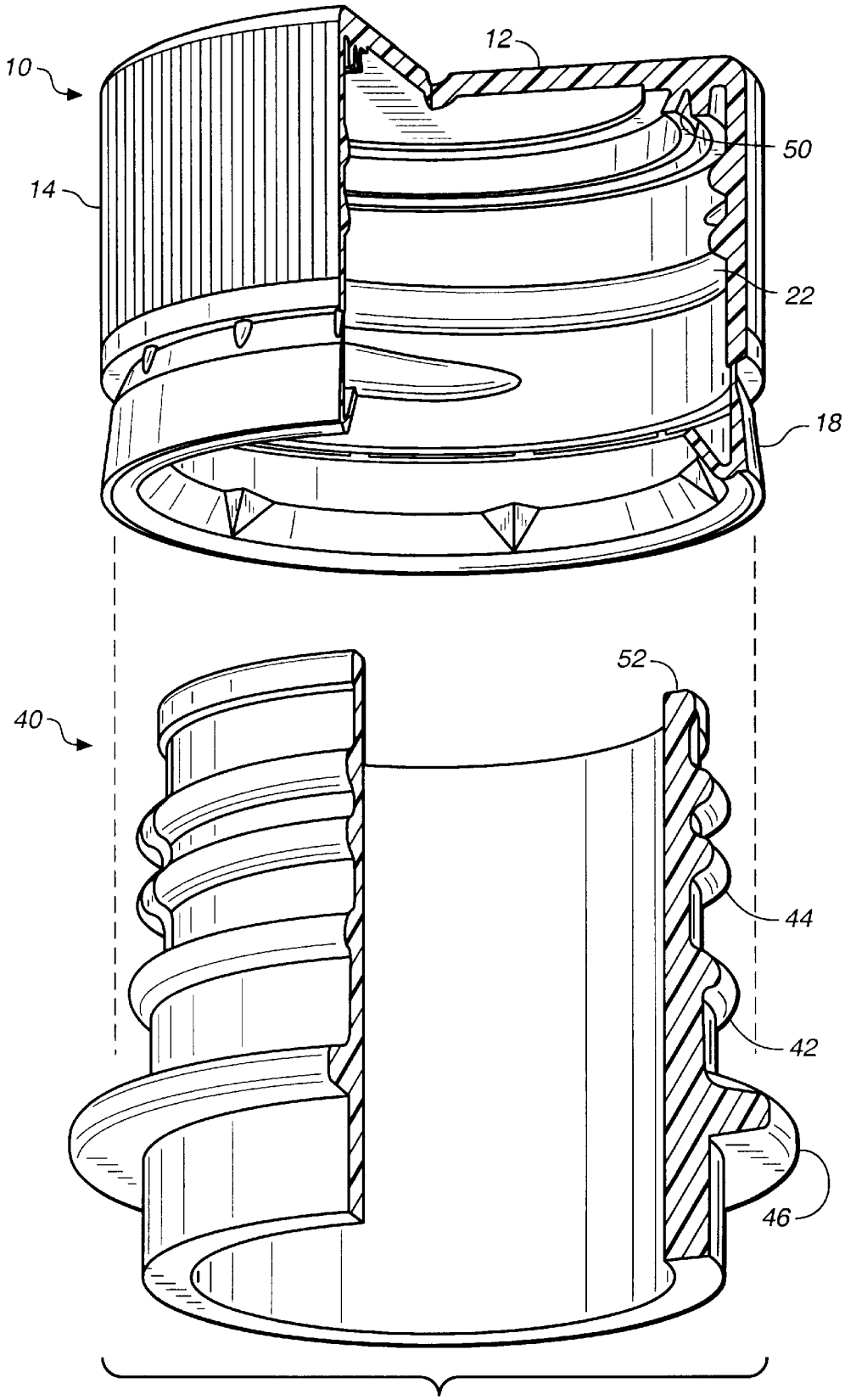
FIG. 9 is an exploded pictorial view of the bottle cap and container neck of FIG. 8.

FIGS. 8 and 9 illustrate a design for a conventional bottle neck 40. The design of bottle neck 40 forms no part of the present invention aside from the fact that the bottle neck 40 requires some type of locking surface 42, such as an annular bead, rim or the like. The rest of the features of bottle neck 40 are conventional in design, including thread 44 and annular base flange 46. The retaining rim of the bottle cap locks underneath locking surface 42.

Also shown in FIGS. 8 and 9 is an internal annular groove 50, which mates with the upper rim 52 of bottle neck 40. This creates a leak-proof seal around the opening of the bottle neck 40.

Figure 10:
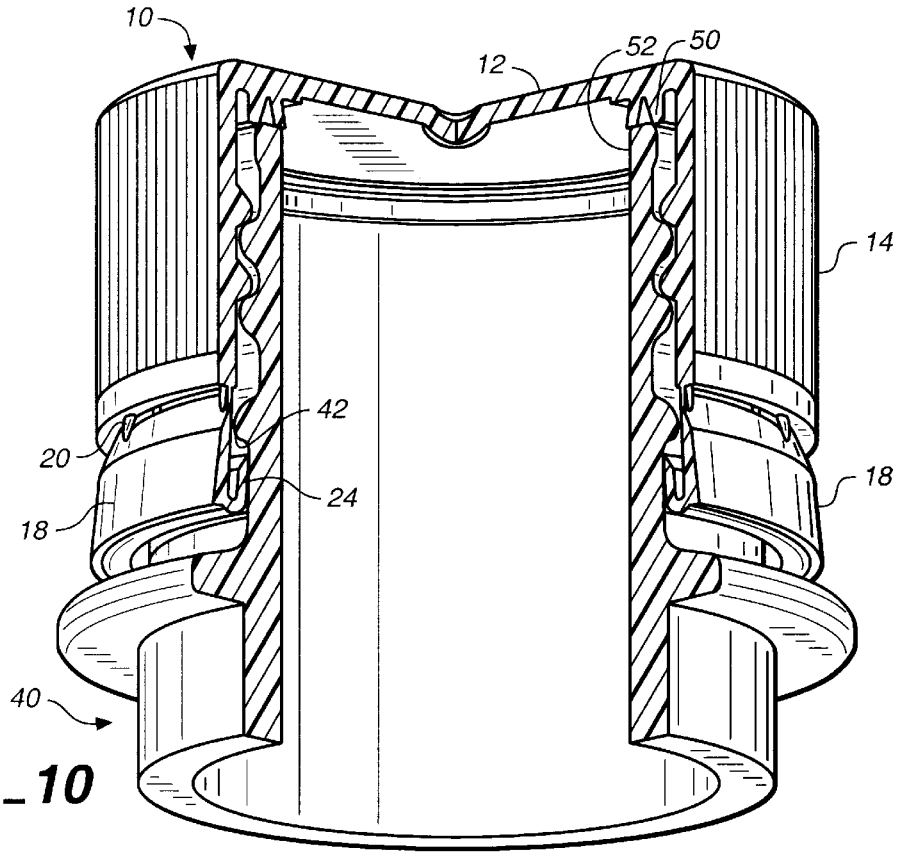
FIG. 10 is a quarter section pictorial view of the bottle cap mounted onto the container neck.
Figure 11:
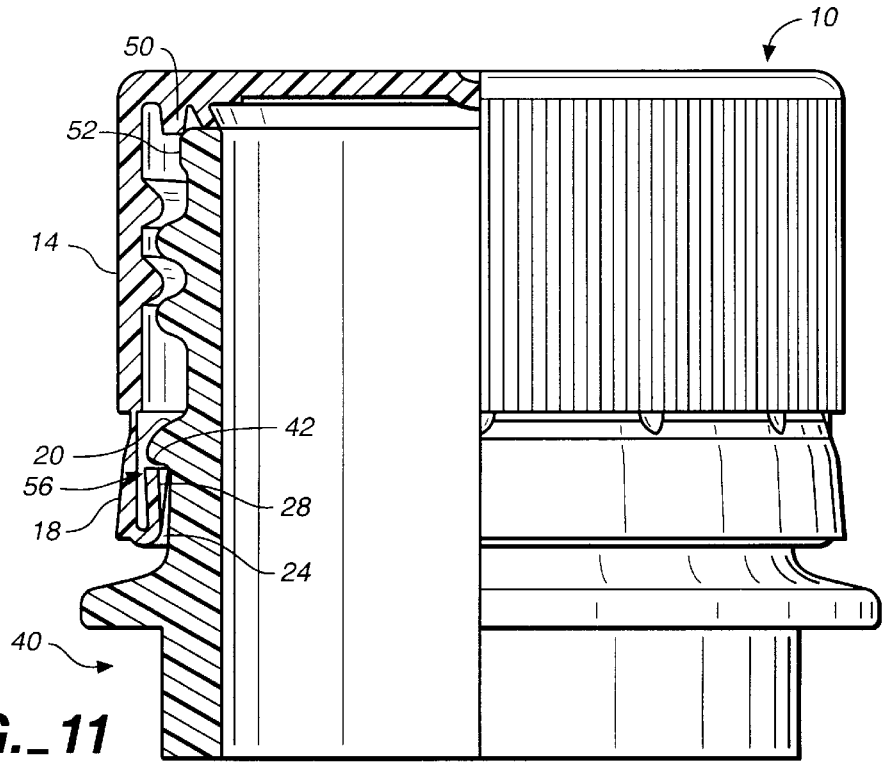
FIG. 11 is a side elevation view, shown in partial section, of the bottle cap mounted onto the container neck.

FIGS. 10 and 11 show bottle cap 10 thread mounted onto bottle neck 40. Retaining rim 24 is bent and flexed outwardly to expand its diameter to match the diameter of bottle neck 40. The upper edge of retaining rim 24, including the upper edge of pleats 28, engage locking surface 42. It can be seen in FIG. 11 that there is a small gap 56 between pleat 28 and the inside wall of tamper-indicating band 18.

When bottle cap 10 is unscrewed off of bottle neck 40, retaining rim 24 engages locking surface 42. Due to the position of frangible connections 20 on the outside of locking surface 42, a slight torque is placed on the retaining rim, which may tend to cause retaining rim 24 to move outwardly toward tamper-indicating band 18. If this happens, pleats 28 engage band 18 and prevent the upper free edge of the retaining rim from moving outwardly from underneath the locking surface, which would allow the tamper-indicating band to slip over the locking surface without breaking the frangible connections.

Another advantage of the design of the tamper-indicating band of the present invention is that it is more difficult to "tamper" with the band. Theoretically, it is possible to pry the tamper-indicating band out beyond the locking surface, with the use of a flat edge tool such as a standard screw driver. With prior art designs, only the inwardly directed pleats needed to be pried out over the locking surface. With the present design, because the retaining rim includes arcuate portions that engage the locking surface across at least a majority of the upper free edge surface of the retaining rim, it is more difficult to pry outwardly enough of the retaining rim to slip the tamper-indicating band out over the locking surface.

Figure 12:
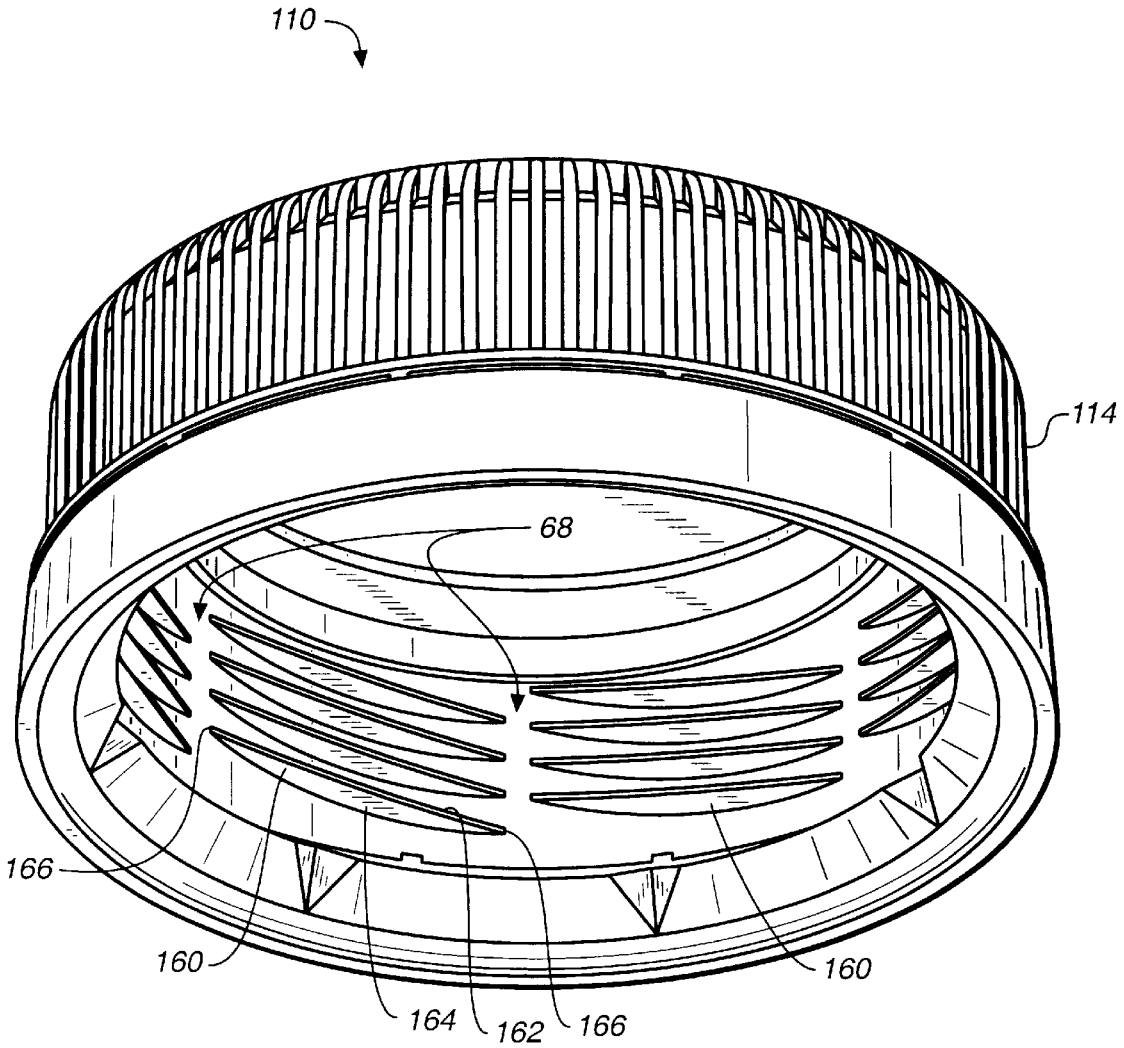
FIG. 12 is a pictorial view of an alternative embodiment of the internal thread pattern of the bottle cap of FIG. 1.

FIG. 12 illustrates the design for an alternative embodiment for the internal thread pattern of the bottle cap 110. It can be seen that the thread pattern is formed by a series of thread segments 160. Each thread segment 160 is shaped like a chord segment with a straight inner edge 162 that creates a wider depth at its center 164 and progressively becomes shallower out to its ends 166, where it becomes flush with the inner surface of skirt 114.

Thread segments 160 are vertically aligned with the segments above and below in a manner that creates gaps 168. In addition, thread segments 160 are aligned along a spiral path with the segments at either side, so as to create an intermittently defined thread channel for the thread of a container neck.

An advantage of the thread design shown in FIG. 12 is not only that it creates a much more light weight bottle cap, it is also much easier to manufacture from a tooling standpoint. Molds for injection molding bottle caps like those discussed herein can more easily be fabricated for producing thread segments as shown.

Figure 13:
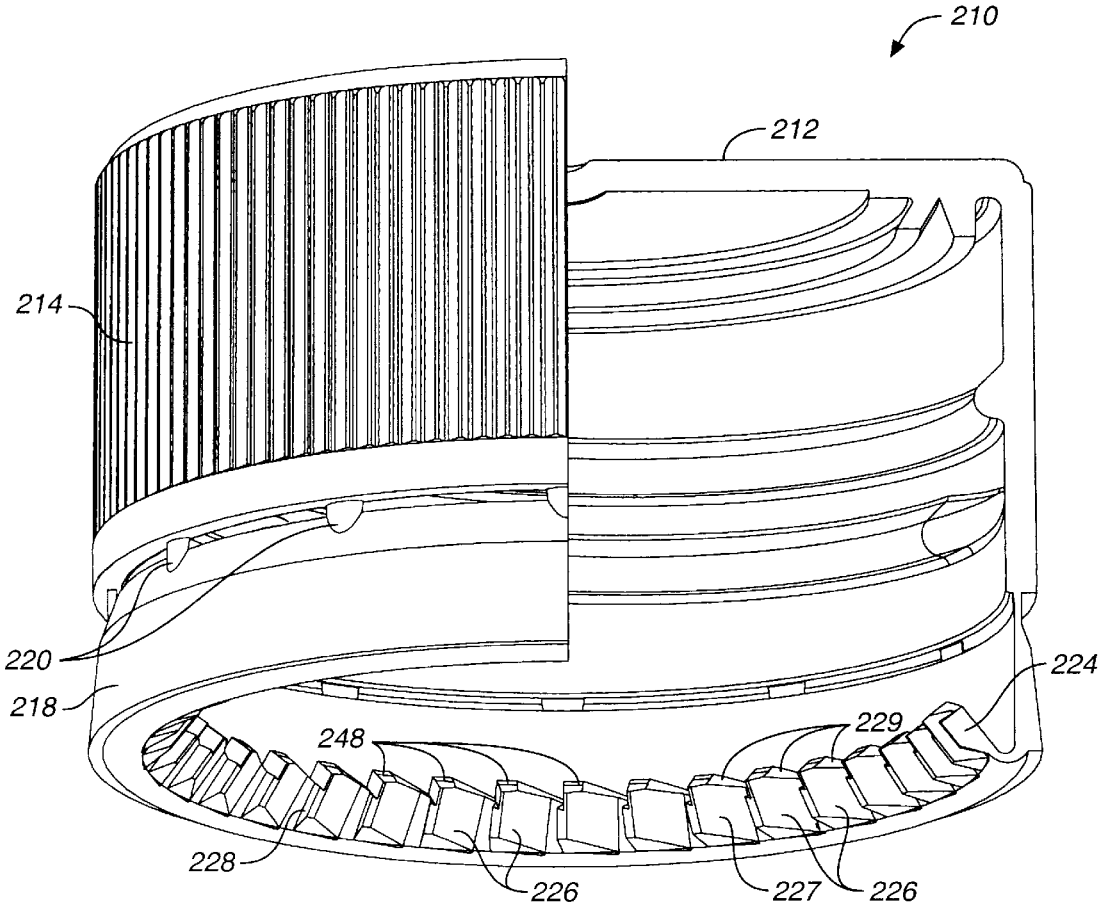
FIG. 13 is a pictorial view from underneath of a third embodiment of the improved tamper-evident cap of the present invention, shown with a quarter section cut away.
Figure 14:
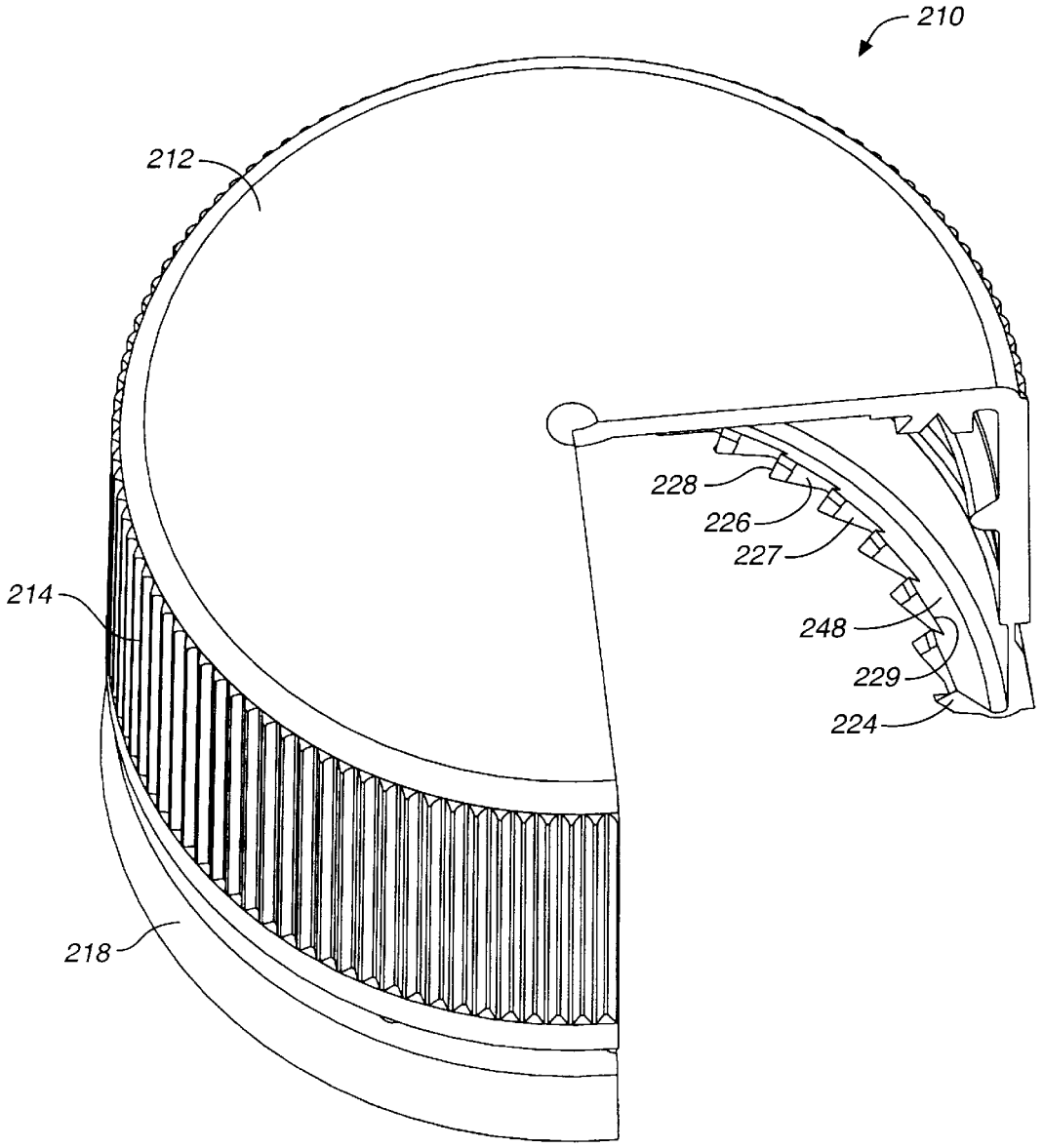
FIG. 14 is a pictorial view from above of the tamper-evident cap of the present invention.

FIGS. 13 and 14 show another alternative embodiment for the tamper-evident band of the present invention. Cap 210 is similar to cap 10 of FIG. 1, except that tamper-indicating band 218 has been modified. Cap 210 includes a top 212 and a skirt 214 10 and breakable connections 220 still connect skirt 214 to band 218. Tamper band 218 includes an inwardly and upwardly turned, annular retaining rim 224. However, rather than including outward pleats, retaining rim 224 includes wedge or ramp elements 226 that form part of a rachet mechanism for securing the tamper band. Ramp elements 226 each include a ramp surface 227 and a blunt radial side 228. Ramp elements 226 also include an upper ramp surface 229 that also forms part of a one-way rachet mechanism for screwing on cap 210, as discussed herein.

Figure 15:
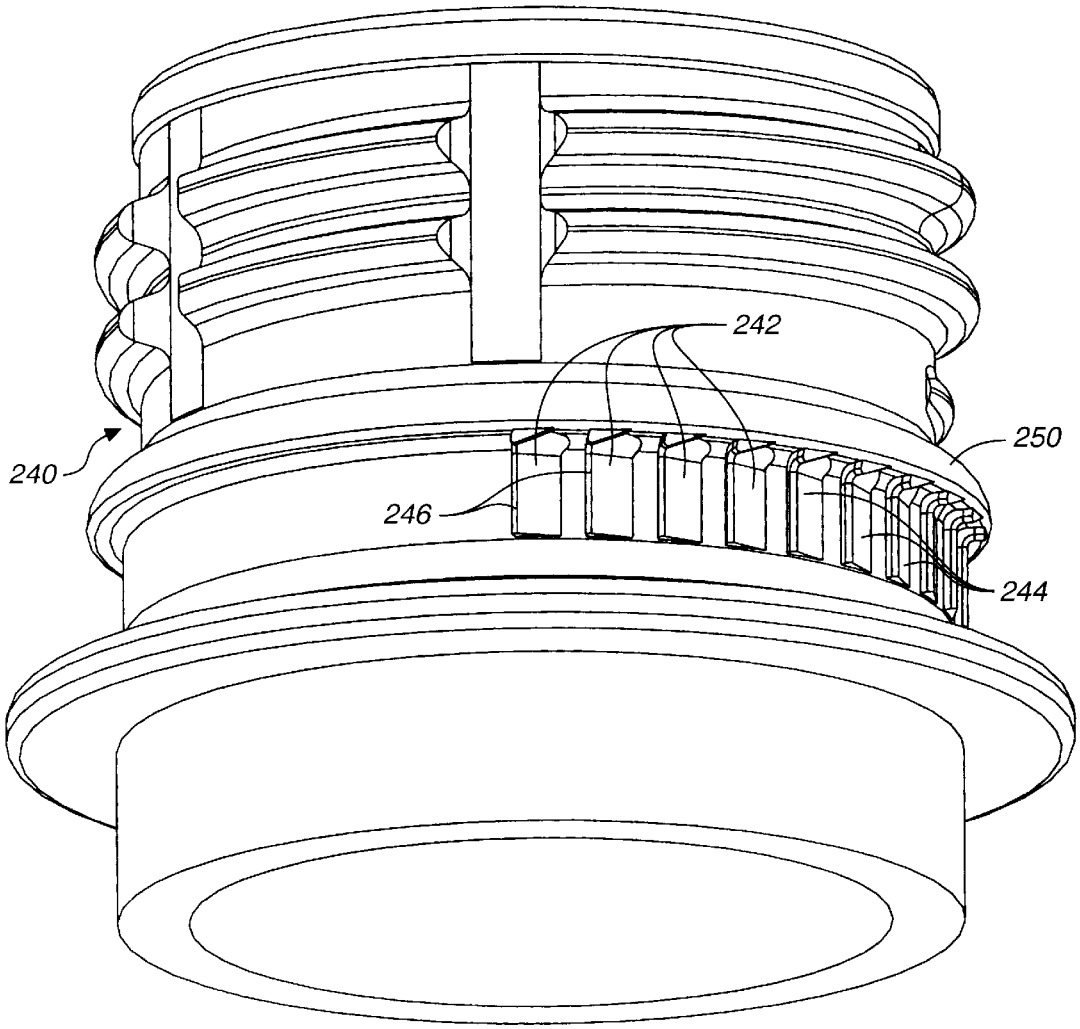
FIG. 15 is a pictorial view of an improved neck design for screwing the cap of FIG. 13 onto.
Figure 16:
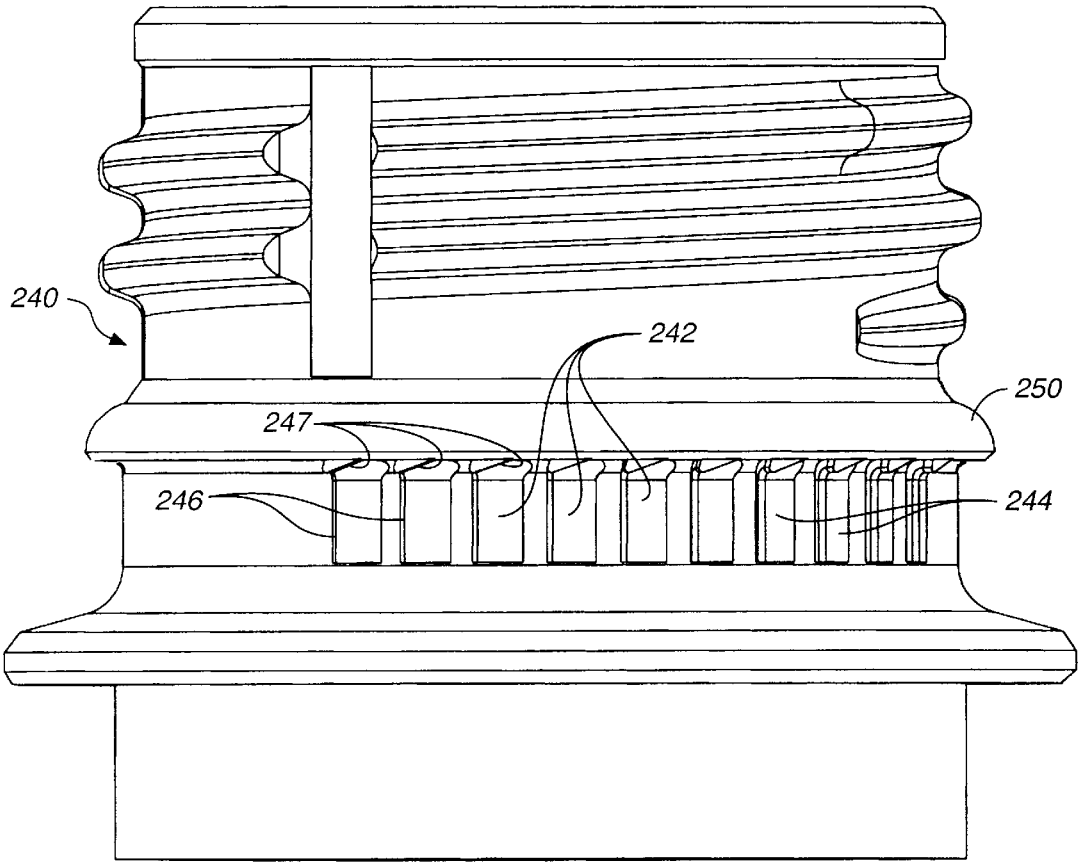
FIG. 16 is a side elevation view of the neck of FIG. 15.

FIGS. 15 and 16 show the neck 240 of a bottle that has similarly been modified to include a series of annularly spaced ramp elements 242, which also form part of the rachet mechanism. The neck ramp elements 242 do not extend all the way around the neck, which is not believed to be necessary in order to restrain the cap, and in fact simplifies the manufacturing process for the neck. However, the ramp elements could extend annularly all around the neck if required. Each ramp element 242 includes an outwardly facing ramp surface 244, and a blunt side edge 246, similar to the ramp elements of the cap. The neck ramp elements 242 also include downwardly facing ramps 247 that extend radially outwardly, but not beyond the edge of a retaining rim 250.

Ramp surfaces 244, 247 and side edges 246 work in conjunction with ramp elements 226 of cap 210 to permit threading of cap 210 onto neck 240, as the respective ramp surfaces engage one another, and the blunt edges slide past one another.

Once threaded onto neck 240, the upper edges 248 of ramp elements 226 engage locking rim 250 of neck 240, thereby preventing upward release of the cap. Also, once threaded on, the blunt sides 228 of ramp elements 226 engage the blunt sides 246 of ramp elements 244, which prevents unthreading of tamper-evident band 218. Ramp surfaces 244 and 227, and 229, 247 allow for easier mounting of the cap fully onto the neck.

In operation, cap 210 is threaded onto neck 240 until ramp elements 226 pop beneath locking rim 250. Then, to unscrew cap 210, skirt portion 214 is counter-rotated against the retention forces provided by the rachet engagement of the ramp elements, which prevent unthreading of the tamper-evident band. Once the counter-rotational forces are great enough, breakable connections 220 fracture, thereby releasing cap 210 to continue unscrewing from the neck.

The rachet design of retaining rim 218 and neck 240 provides a design for easy breaking of connections 220 and in addition provides sufficient surface area on the tops of ramp elements 226 to retain band 218 beneath locking rim 250. Alternatively, inwardly directed pleats could be provided in combination with ramp elements in order to prevent outward flexing of retaining rim 24.

An advantage of the rachet mechanism of the present invention is that it significantly improves the tamper evident feature of the bottle cap. With prior art tamper evident bands, it is possible to rotate the cap a certain amount before the breakable connections separated, which can break the seal lock of the cap without breaking off the connections. Thus, it is possible to rupture the seal lock without breaking the breakable connections, which creates the appearance of a proper seal when in fact the seal may have been broken. The present invention prevents any rotation of the tamper band. As such, the breakable connections will separate before the seal is broken, which is the desired result for providing an indication of tampering.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a tamper-indicating closure, and a container having a neck defining a neck opening and having a locking surface on the neck of the container spaced from the neck opening, the locking surface being substantially horizontally oriented when the container is upright, the tamper-indicating closure including a top portion and a depending annular skirt for sealing the container neck and a tamper-indicating band connected to the lower edge of the annular skirt by means of a breakable connection, the tamper-indicating band including tamper evidencing means including an inwardly turned retaining rim that extends at least partially upwardly, the retaining rim including a free edge that is adapted to engage the horizontally oriented locking surface of the container neck when the closure is removed from the container neck, the retaining rim including additional tamper evidencing means for use in indicating breakage of the seal formed by the top portion of the closure.

2. The combination of claim 1 wherein, the retaining rim includes outwardly directed flutes.

3. The combination of claim 1 wherein, the retaining rim extends inwardly as well as upwardly and is sufficiently vertically oriented so that engagement of the free edge of the retaining rim with the locking surface prevents upward movement of the retaining rim.

4. The combination of claim 3 wherein, the spacing between locking surface and the neck opening is approximately equal to the spacing between the free edge of the retaining rim and the top portion of the closure, so that upon full mounting of the closure on the container neck, the retaining rim is positioned beneath the locking surface with the free edge of the retaining rim proximal the locking surface.

5. The combination of claim 1 wherein, the breakable connection includes frangible elements, the retaining rim includes outwardly directed flutes to prevent outward flexing of the retaining rim, and wherein some of the frangible elements are aligned vertically with the flutes.

6. The combination of claim 5 wherein, the breakable connection includes a series of equally spaced frangible elements and the retaining rim includes a series of equally spaced flutes, and wherein each flute aligns vertically with a frangible connection.

7. The combination of claim 1 wherein, the additional tamper evidencing means includes a rachet mechanism that provides for one-way screwing of the closure cap onto the neck.

8. The combination of claim 5 wherein, the ratchet mechanism includes a first set of ratchets with ramp surfaces that are aligned substantially horizontally so that the ramp surfaces face substantially downwardly and a second set of ratchets with ramp surfaces that are aligned substantially vertically.

9. The combination of claim 7 wherein, the ratchet mechanism includes ratchets on the retaining rim and ratchets on the neck that cooperate with the ratchets on the retaining rim.

10. The combination of claim 9 wherein, the ratchets include ramp surfaces.

11. The combination of claim 10 wherein, the ramp elements include ramp surfaces that are aligned substantially horizontally so that the ramp surfaces face substantially downwardly.

12. The combination of claim 10 wherein, the ramp surfaces are aligned at an angle so that they face slightly downwardly.

13. The combination of claim 12 wherein, the ramp elements include tapered bottom edges adjacent the ramp surfaces.

* * * * *